US011482204B2

(12) United States Patent
Tachi et al.

(10) Patent No.: US 11,482,204 B2
(45) Date of Patent: Oct. 25, 2022

(54) ACTIVE NOISE CONTROL SYSTEM

(71) Applicants: ALPS ALPINE CO., LTD., Tokyo (JP); A School Corporation Kansai University, Suita (JP)

(72) Inventors: Ryosuke Tachi, Iwaki (JP); Yuji Saito, Iwaki (JP); Yoshinobu Kajikawa, Suita (JP)

(73) Assignees: ALPS ALPINE CO., LTD., Tokyo (JP); A SCHOOL CORPORATION KANSAI UNIVERSITY, Osaka (JP)

( * ) Notice: Subject to any disclaimer, the term of this patent is extended or adjusted under 35 U.S.C. 154(b) by 0 days.

(21) Appl. No.: 17/362,413

(22) Filed: Jun. 29, 2021

(65) Prior Publication Data

US 2022/0005453 A1 Jan. 6, 2022

(30) Foreign Application Priority Data

Jul. 3, 2020 (JP) ..... JP2020-115503

(51) Int. Cl.
*G10K 11/178* (2006.01)

(52) U.S. Cl.
CPC .... *G10K 11/17854* (2018.01); *G10K 11/1783* (2018.01); *G10K 11/17813* (2018.01); *G10K 2210/3033* (2013.01); *G10K 2210/3221* (2013.01)

(58) Field of Classification Search
CPC ..... G10K 2210/3033; G10K 2210/3221
See application file for complete search history.

(56) References Cited

U.S. PATENT DOCUMENTS 5,267,320 A * 11/1993 Fukumizu ..... G10K 11/17857 381/71.12
2006/0285697 A1 12/2006 Nishikawa et al.
2010/0124337 A1 5/2010 Wertz et al.
2020/0211526 A1 7/2020 Tachi et al.

FOREIGN PATENT DOCUMENTS

JP 2018-072770 5/2018

OTHER PUBLICATIONS

European Search Report dated Nov. 18, 2021 in corresponding European Application No. 21181720.0, 9 pages.

* cited by examiner

*Primary Examiner* — Ping Lee
(74) *Attorney, Agent, or Firm* — Crowell & Moring LLP

(57) ABSTRACT

In a first system signal processing unit, a first system auxiliary filter generates a correction signal for correcting an error signal from a noise signal, a first system subtractor subtracts the correction signal from an output of a first microphone to obtain an error signal, an adaptive filter performs an adaptive operation using the error signal to generate a cancel sound output from a first speaker, and a DMS detects a position of a user's ear. When the position of the user's ear moves, the controller stops the adaptive operation, updates the transfer function of the first system auxiliary filter to the transfer function corresponding to the noise cancel position matching the position of the user's ear, gradually changes the transfer function of the adaptive filter to the transfer function corresponding to the matching noise cancel position, and resumes the adaptive operation after the change is completed.

8 Claims, 8 Drawing Sheets

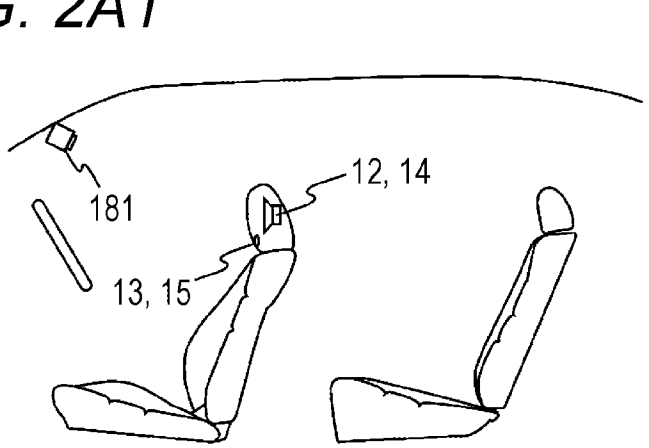
FIG. 2A1
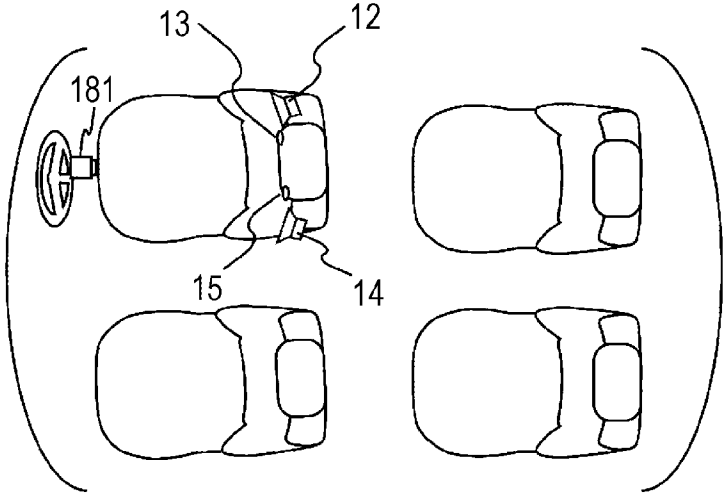
FIG. 2A2
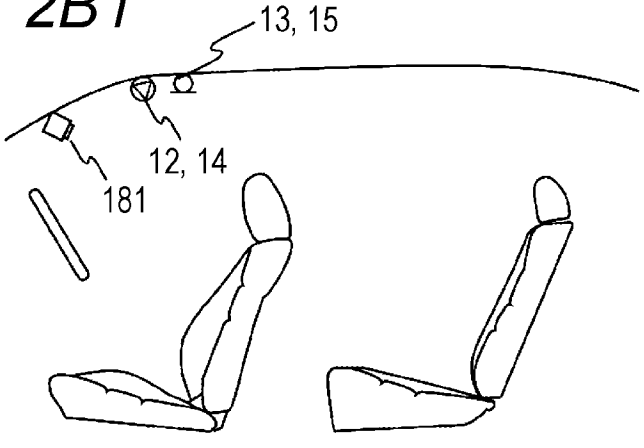
FIG. 2B1
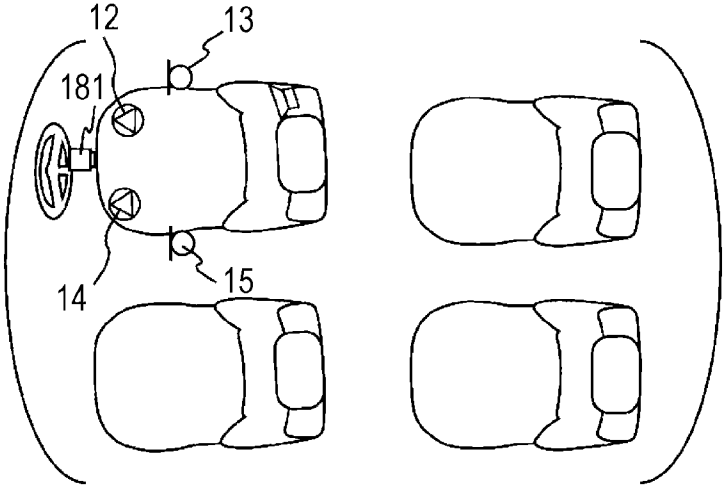
FIG. 2B2

FIG. 4

| CANCEL POINT SET | FIRST SYSTEM AUXILIARY FILTER SETTING VALUE | SECOND SYSTEM AUXILIARY FILTER SETTING VALUE | FIRST VARIABLE FILTER INITIAL VALUE | SECOND VARIABLE FILTER INITIAL VALUE |
|---|---|---|---|---|
| P1 = (P1_1, P2_1) | H1_1(z) | H2_1(z) | W1_1(z) | W2_1(z) |
| P1 = (P1_2, P2_2) | H1_2(z) | H2_2(z) | W1_2(z) | W2_2(z) |
| ⋮ | ⋮ | ⋮ | ⋮ | ⋮ |
| P1 = (P1_n, P2_n) | H1_n(z) | H2_n(z) | W1_n(z) | W2_n(z) |

FILTER MANAGEMENT TABLE

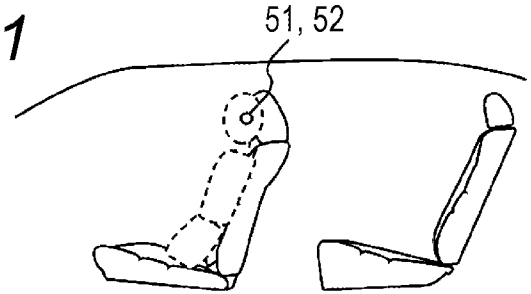
FIG. 5B1
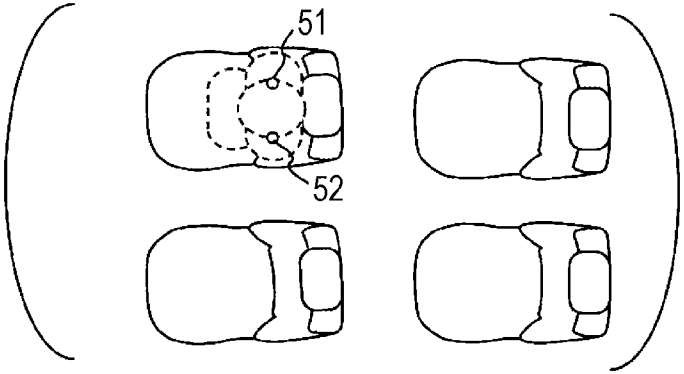
FIG. 5B2
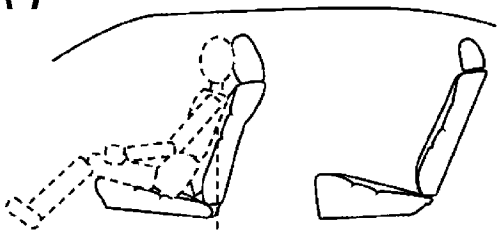
FIG. 5A1
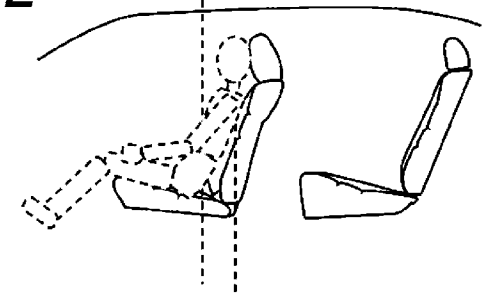
FIG. 5A2
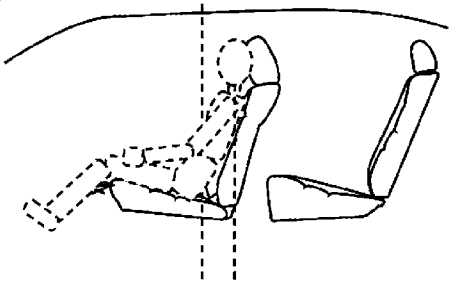
FIG. 5A3

ACTIVE NOISE CONTROL SYSTEM

RELATED APPLICATION

The present application claims priority to Japanese Patent Application Number 2020-115503, filed Jul. 3, 2020, the entirety of which is hereby incorporated by reference.

BACKGROUND

1. Field of the Invention

The present invention relates to active noise control (ANC) technology that reduces noise by emitting noise cancel sound to cancel out noise.

2. Description of the Related Art

As a technology of active noise control that reduces noise by radiating noise cancel sound from which noise is canceled, a technology is known in which a microphone and a speaker that are arranged near a noise cancel position and an adaptive filter that generates the noise cancel sound output from the speaker from an output signal of a noise source or a signal simulating the output signal are provided, and the adaptive filter adapts a transfer function of its own as an error signal, obtained by correcting an output of a microphone using an auxiliary filter (for example, JP 2018-72770 A).

In this technology, a transfer function capable of generating, from a noise signal, a correction signal for correcting a signal actually output by a microphone is set in a signal output from the microphone when the microphone is disposed at a noise cancel position, which is learned in advance, in the auxiliary filter. By using such an auxiliary filter, noise is canceled at a noise cancel position different from a position of the microphone.

In the case of canceling noise heard by a user by using the technology for canceling the noise at the noise cancel position different from the position of the microphone using the above-mentioned auxiliary filter, if ears of a user shift from the noise cancel position along with the movement of the user, the noise heard by the user may not be canceled satisfactorily.

Therefore, the transfer function of the auxiliary filter is learned for a plurality of different noise cancel positions, and the transfer function of the auxiliary filter is switched to the learned transfer function for the noise cancel position corresponding to the positions of the ears of the user along with the displacement of the ears of the user, and as a result, it is possible to cancel the noise heard by the user regardless of the displacement of the ears of the user.

However, in this case, after the transfer function of the auxiliary filter is switched, the noise may be heard by the user until the transfer function of the adaptive filter is adapted to the transfer function that can appropriately cancel the noise at the position of the user's ear.

SUMMARY

An object of the present disclosure is to provide an active noise control system that can satisfactorily cancel noise regardless of the displacement of the user's ear.

In order to achieve the above object, the present disclosure provides an active noise control system for reducing noise, the active noise control system including: a position detection unit configured to detect a listening position that is a position at which a user listens to a sound; a control unit; a speaker configured to output a noise cancel sound; a microphone configured to detect an error signal; an auxiliary filter configured to generate and output a correction signal by applying a transfer function which is set to a noise signal representing noise; an error correction unit configured to correct an error signal that is an output of the microphone with a correction signal output from the auxiliary filter and outputs a corrected error signal; an adaptive filter configured to perform an adaptive operation using the corrected error signal output by the error correction unit to generate a noise cancel sound output from the speaker from the noise signal; and a storage unit configured to store a plurality of noise cancel positions and setting information for setting an adaptive filter initial transfer function corresponding to each of the noise cancel positions in the adaptive filter. However, the control unit sets an auxiliary filter that outputs a correction signal to the error correction unit when a matched noise cancel position, which is a noise cancel position matching a listening position detected by the position detection unit among the plurality of noise cancel positions, changes as an auxiliary filter in which a transfer function for an auxiliary filter corresponding to the matched noise cancel position is set among transfer functions for auxiliary filters corresponding to each of the plurality of noise cancel positions set in advance, and performs a switching operation of updating a transfer function of the adaptive filter to an adaptive filter initial transfer function corresponding to the matched noise cancel position by using the setting information.

In such an active noise control system, in a state in which the adaptive operation of the adaptive filter is stopped in the switching operation and an auxiliary filter that outputs a correction signal to the error correction unit is an auxiliary filter in which a transfer function for an auxiliary filter corresponding to the matched noise cancel position is set, the control unit may be configured to gradually change the transfer function of the adaptive filter to an adaptive filter initial transfer function corresponding to the matched noise cancel position, update the transfer function of the adaptive filter to the adaptive filter initial transfer function, and then restart the adaptive operation of the adaptive filter.

More specifically, in the active noise control system described above, an adaptive filter initial transfer function corresponding to each of the noise cancel positions may be a transfer function that generates a noise cancel sound with which the adaptive filter cancels noise at a noise cancel position corresponding to the adaptive filter initial transfer function under a standard environment when the adaptive filter initial transfer function is set, and a transfer function of the auxiliary filter corresponding to each of the noise cancel positions may be a transfer function that, when the transfer function of the auxiliary filter is set, the auxiliary filter outputs a correction signal in which an error signal that is an output of the microphone is corrected by an error correction unit so that a difference between a noise cancel position corresponding to the transfer function of the auxiliary filter and a position of the microphone is compensated.

Further, in the active noise control system described above, an adaptive filter initial transfer function corresponding to each of the noise cancel positions may be a transfer function that is learned by using a learning microphone disposed at a noise cancel position corresponding to the adaptive filter initial transfer function and with which the adaptive filter generates a noise cancel sound that cancels noise at the corresponding noise cancel position, and a transfer function for an auxiliary filter corresponding to each of the noise cancel positions may be a transfer function learned in advance as a transfer function with which the auxiliary filter outputs a correction signal for correcting the error signal to 0 in an error correction unit in a state where the transfer function of the adaptive filter is fixed to the adaptive filter initial transfer function corresponding to the noise cancel position.

In the active noise control system, the position detection unit may detect a position of a head or an ear of a user seated on a predetermined seat of an automobile as the listening position.

According to the active noise control system as described above, when the listening position where the user listens to the sound is displaced, in addition to the transfer function of the auxiliary filter, the transfer function of the adaptive filter can also be updated to a transfer function approximate to the transfer function that cancels the noise at the noise cancel position matching the listening position. In this way, the noise can be canceled at the noise cancel position matching the listening position immediately by the subsequent adaptive operation.

In addition, by gradually updating the transfer function of the adaptive filter, it is also possible to suppress an unnatural sound from being output to the user along with the update. The present disclosure also provides an active noise control system in which the active noise control system as described above is applied to cancellation of noise at each of left and right ear positions of a user. That is, the present disclosure also provides an active noise control system including a position detection unit that detects positions of left and right ears of a user, a control unit, two noise control systems of a right ear noise control system and a left ear noise control system, and a storage unit. Each noise control system includes: a speaker configured to output a noise cancel sound; a microphone configured to detect an error signal; an auxiliary filter configured to generate and output a correction signal by applying a transfer function set to a noise signal representing noise; an error correction unit configured to correct an error signal that is an output of the microphone with a correction signal output from the auxiliary filter and outputs the corrected error signal; and an adaptive filter configured to perform an adaptive operation using a corrected error signal output from the error correction unit of the right ear noise control system and a corrected error signal output from the error correction unit of the left ear noise control system to generate a noise cancel sound output from the speaker from the noise signal. In addition, the storage unit stores a plurality of noise cancel position sets with a set of a first noise cancel position and a second noise cancel position as a noise cancel position set, and setting information for setting a first adaptive filter initial transfer function and a second adaptive filter initial transfer function corresponding to each noise cancel position set to an adaptive filter of the right ear noise control system for a first adaptive filter initial transfer function and to an adaptive filter of the left ear noise control system for a second adaptive filter initial transfer function. Further, when a matched noise cancel position set, which is a noise cancel position set matched with a set of left and right ear positions of the user detected by the position detection unit, of the plurality of noise cancel position sets changes, the control unit performs a switching operation in which an auxiliary filter that outputs a correction signal to the error correction unit of the right ear noise control system is set to an auxiliary filter in which a transfer function for a first auxiliary filter corresponding to the matched noise cancel position set of transfer functions for the first auxiliary filters each of which corresponds to each of the plurality of noise cancel position sets set in advance, the transfer function for the adaptive filter of the right ear noise control system is updated to a first adaptive filter initial transfer function corresponding to the matched noise cancel position set using the setting information, an auxiliary filter that outputs a correction signal to the error correction unit of the left ear noise control system is set to an auxiliary filter in which a transfer function for a second auxiliary filter corresponding to the matched noise cancel position set of transfer functions for the second auxiliary filters each of which corresponds to each of the plurality of noise cancel position sets set in advance, and a transfer function of the adaptive filter of the left ear noise control system is updated to a second adaptive filter initial transfer function corresponding to the matched noise cancel position set using the setting information.

In such an active noise control system, in the switching operation, in a state where an auxiliary filter that stops an adaptive operation of the adaptive filters of the right ear noise control system and the left ear noise control system and outputs a correction signal to the error correction unit of the right ear noise control system is an auxiliary filter in which a transfer function for a first auxiliary filter corresponding to the matched noise cancel position set is set, and an auxiliary filter that outputs a correction signal to the error correction unit of the left ear noise control system is an auxiliary filter in which a transfer function for a second auxiliary filter corresponding to the matched noise cancel position set is set, the control unit may be configured to update a transfer function of an adaptive filter of the right ear noise control system to a first adaptive filter initial transfer function corresponding to the matched noise cancel position set by gradually changing the transfer function to the first adaptive filter initial transfer function, update a transfer function of an adaptive filter of the left ear noise control system to a second adaptive filter initial transfer function corresponding to the matched noise cancel position set by gradually changing the transfer function to the second adaptive filter initial transfer function, and then resume an adaptive operation of the adaptive filters of the right ear noise control system and the left ear noise control system.

Further, in such an active noise control system, the matched noise cancel position set may be a noise cancel position set in which a predicted position of the right ear of the user is matched with the first noise cancel position, and a predicted position of the left ear of the user is matched with the second noise cancel position, the first adaptive filter initial transfer function and the second adaptive filter initial transfer function corresponding to each of the noise cancel position sets may be transfer functions for generating a noise cancel sound with which adaptive filters of the right ear noise control system and the left ear noise control system cancel noise at the first noise cancel position and the second noise cancel position of a noise cancel position set corresponding to the first adaptive filter initial transfer function and the second adaptive filter initial transfer function under a standard environment when the first adaptive filter initial transfer function is set to the right ear noise control system and the second adaptive filter initial transfer function is set to the left ear noise control system, and a transfer function for a first auxiliary filter corresponding to each of the noise cancel position sets may be a transfer function with which, when the transfer function for the first auxiliary filter is set in the right ear noise control system, the auxiliary filter outputs a correction signal in which an error signal that is an output of the microphone is corrected by an error correction unit such that a difference between a first noise cancel position of a noise cancel position set corresponding to the transfer function for the first auxiliary filter and a position of a microphone is compensated, and a transfer function for a second auxiliary filter corresponding to each of the noise cancel position sets may be a transfer function with which, when the transfer function for the second auxiliary filter is set in the left ear noise control system, the auxiliary filter outputs a correction signal in which an error signal that is an output of the microphone is corrected by an error correction unit such that a difference between a second noise cancel position of a noise cancel position set corresponding to the transfer function for the second auxiliary filter and a position of a microphone is compensated.

Further, in such an active noise control system, the first adaptive filter initial transfer function and the second adaptive filter initial transfer function corresponding to each of the noise cancel position sets may be transfer functions generated by the adaptive filters of the right ear noise control system and the left ear noise control system for noise cancel sounds that cancel noise at the first noise cancel position and the second noise cancel position of the corresponding noise cancel position set, the noise cancel sounds having been learned using the first learning microphone arranged at the first noise cancel position of the noise cancel position set and the second learning microphone arranged at the second noise cancel position of the noise cancel position set, and in a state where a transfer function of the adaptive filter of the right ear noise control system is fixed to the first adaptive filter initial transfer function corresponding to the first noise cancel position of the noise cancel position set and a transfer function of the adaptive filter of the left ear noise control system is fixed to the second adaptive filter initial transfer function corresponding to the second noise cancel position of the noise cancel position set, in the right ear noise control system, the transfer function for the first auxiliary filter corresponding to each of the noise cancel position sets may be a transfer function learned in advance as a transfer function with which the auxiliary filter outputs a correction signal for correcting the error signal to 0 in an error correction unit, and in a state where a transfer function of an adaptive filter of the right ear noise control system is fixed to the first adaptive filter initial transfer function corresponding to the first noise cancel position of the noise cancel position set and a transfer function of an adaptive filter of the left ear noise control system is fixed to the second adaptive filter initial transfer function corresponding to the second noise cancel position of the noise cancel position set, in the left ear noise control system, the transfer function for the second auxiliary filter corresponding to each of the noise cancel position sets may be a transfer function learned in advance as a transfer function with which the auxiliary filter outputs a correction signal for correcting the error signal to 0 in an error correction unit.

In such an active noise control system, the position detection unit may detect positions of left and right ears of a user seated on a predetermined seat of an automobile.

As described above, according to the present disclosure, it is possible to provide an active noise control system that can satisfactorily cancel noise regardless of the displacement of the user's ear.

BRIEF DESCRIPTION OF THE DRAWINGS

FIGS. 2A1, 2A2, 2B1, and 2B2 are diagrams illustrating an arrangement of speakers and microphones in the active noise control system according to the embodiment of the invention;

FIG. 4 is a diagram illustrating a filter management table according to the embodiment of the invention;

FIGS. 5A1, 5A2, 5A3, 5B1, and 5B2 are diagrams illustrating a method of setting a cancel point according to the embodiment of the invention;

DETAILED DESCRIPTION OF THE PREFERRED EMBODIMENTS

Hereinafter, embodiments of the invention will be described.

Figure 1:
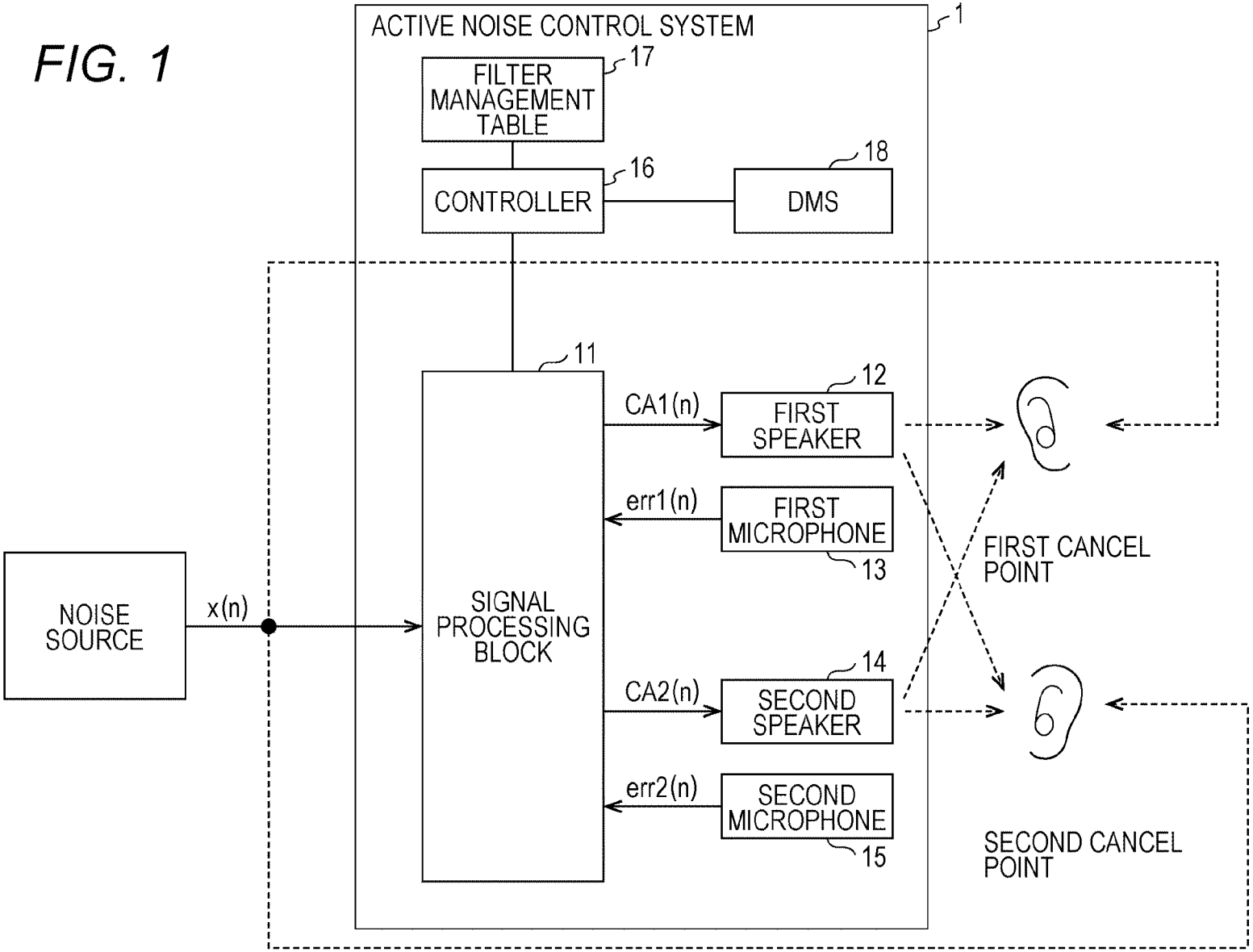
FIG. 1 is a block diagram illustrating a configuration of an active noise control system according to an embodiment of the invention.

FIG. 1 illustrates a configuration of an active noise control system according to one embodiment.

As illustrated in the drawing, an active noise control system 1 includes a signal processing block 11, a first speaker 12, a first microphone 13, a second speaker 14, a second microphone 15, a controller 16, a filter management table 17, and a driver monitoring system 18 (DMS 18) that detects the positions of the head and ears of a user.

The active noise control system 1 according to this embodiment is a system mounted in an automobile, and that cancels noise generated by a noise source at each of two cancel points with a position of the right ear of the user seated in a noise cancel target seat that is a seat of the automobile to be subjected to noise cancel as a first cancel point and a position of a left ear of the user as a second cancel point.

For example, as illustrated in FIGS. 2A1 and 2A2, the DMS 18 detects the position of the user's head or ear from a video or the like of the user seated in the noise cancel target seat captured by a near infrared camera 181 disposed in front of the noise cancel target seat (the driver's seat in the drawing).

As illustrated in FIGS. 2A1 and 2A2, the first speaker 12 and the first microphone 13 are disposed in a headrest of the noise cancel target seat (the driver's seat in the drawing) at a position near the position of the right ear of the user seated in the seat, and the second speaker 14 and the second microphone 15 are disposed in a headrest of the seat of the user whose noise is to be canceled at a position near the position of the left ear of the user seated in the seat.

Alternatively, as illustrated in FIGS. 2B1 and 2B2, the first speaker 12 may be disposed at a position above and in front of the standard position of the right ear of the user seated in the noise cancel target seat on the ceiling of the passenger compartment of the automobile, the second speaker 14 may be disposed at a position above and in front of the standard position of the left ear of the user seated in the noise cancel target seat on the ceiling of the passenger compartment, the first microphone 13 may be disposed at a position on the right side of the first speaker 12 and closer to the noise cancel target seat than the first speaker 12 on the ceiling in front of the user, and the second microphone 15 may be disposed at a position on the left side of the second speaker 14 and closer to the noise cancel target seat than the second speaker 14, on the ceiling in front of the user. When the first speaker 12 and second speaker 14 are disposed on the ceiling as described above, superdirective parametric speakers are preferably used as the first speaker 12 and the second speaker 14.

Referring back to FIG. 1, using a noise signal x(n) indicating the noise generated by the noise source, a first microphone error signal err1(n) that is a voice signal picked up by the first microphone 13, and a second microphone error signal err2(n) that is a voice signal picked up by the second microphone 15, the signal processing block 11 generates a first cancel signal CA1(n) and outputs the first cancel signal CA1(n) from the first speaker 12, and generates a second cancel signal CA2(n) and outputs the second cancel signal CA2(n) from the second speaker 14.

Then, the noise generated by the noise source is cancelled at the first cancel point and the second cancel point by the first cancel signal CA1(n) output from the first speaker 12 and the second cancel signal CA2(n) output from the second speaker 14.

Figure 3:
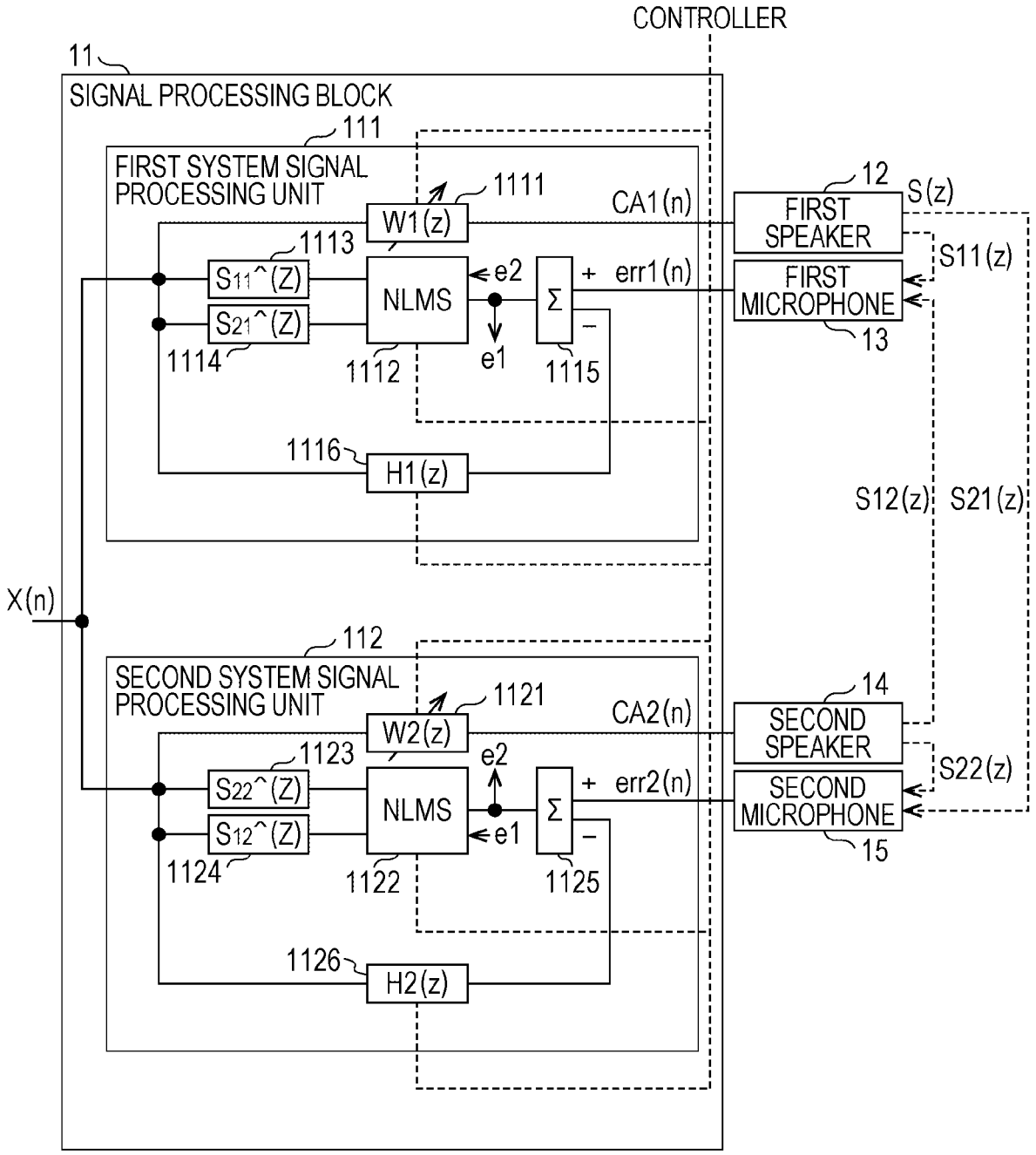
FIG. 3 is a block diagram illustrating the configuration of a signal processing block according to the embodiment of the invention.

The signal processing block 11 includes, as illustrated in FIG. 3, a first system signal processing unit 111 that mainly performs processing relevant to the generation of the first cancel signal CA1(n) and a second system signal processing unit 112 that mainly performs processing relevant to the generation of the second cancel signal CA2(n).

As illustrated in FIG. 3, a first system signal processing unit 111 includes a first system variable filter 1111, a first system adaptive algorithm execution unit 1112, a first system first-stage estimation filter 1113 in which a transfer function S11ˆ(z) is set in advance, a first system second-stage estimation filter 1114 in which a transfer function S21ˆ(z) is set in advance, a first system subtractor 1115, and a first system auxiliary filter 1116 to which a transfer function H1(z) is set.

In such a configuration of the first system signal processing unit 111, the input noise signal x(n) is output to the first speaker 12 as the first cancel signal CA1(n) through the first system variable filter 1111.

In addition, the input noise signal x(n) is transmitted to the first system subtractor 1115 through the first system auxiliary filter 1116, and the first system subtractor 1115 subtracts the output of the first system auxiliary filter 1116 from the first microphone error signal err1(n) picked up by the first microphone 13 and outputs the result, as an error e1, to the first system adaptive algorithm execution unit 1112 and the second system signal processing unit 112.

The first system variable filter 1111, the first system adaptive algorithm execution unit 1112, the first system first-stage estimation filter 1113, and the first system second-stage estimation filter 1114 form a filtered-X adaptive filter. In the first system first-stage estimation filter 1113, an estimated transfer characteristic S11ˆ(z) of a transfer function S11(z) from the first system signal processing unit 111 to the first microphone 13 calculated by actual measurement or the like is set in advance. The first system first-stage estimation filter 1113 convolves the input noise signal x(n) with the transfer characteristic S11ˆ(z) and inputs the resultant signal to the first system adaptive algorithm execution unit 1112. In addition, in the first system second-stage estimation filter 1114, an estimated transfer characteristic S21ˆ(z) of a transfer characteristic S21(z) indicating a transfer function from the first system signal processing unit 111 calculated to the second microphone 15 by actual measurement or the like is set in advance. The first system second-stage estimation filter 1114 convolves the input noise signal x(n) with the transfer characteristic S21ˆ(z) and inputs the resultant signal to the first system adaptive algorithm execution unit 1112.

The first system adaptive algorithm execution unit 1112 receives the noise signal x(n) in which the transfer function S11ˆ(z) is convoluted by the first system first-stage estimation filter 1113, the noise signal x(n) in which the transfer function S21ˆ(z) is convoluted by the first system second-stage estimation filter 1114, the error e1 output from the first system subtractor 1115, and an error e2 output from the second system signal processing unit 112, executes an adaptive algorithm such as NLMS, and performs the adaptive operation of updating a transfer function W1(z) of the first system variable filter 1111 so that the errors become 0.

The second system signal processing unit 112 has the same configuration as the first system signal processing unit 111, and the second system signal processing unit 112 includes a second system variable filter 1121, a second system adaptive algorithm execution unit 1122, a second system first-stage estimation filter 1123 in which a transfer function S22ˆ(z) is set in advance, a second system second-stage estimation filter 1124 in which a transfer function S12ˆ(z) is set in advance, a second system subtractor 1125, and a second system auxiliary filter 1126 in which a transfer function H2(z) is set in advance.

In such a configuration of the second system signal processing unit 112, the input noise signal x(n) is output to the second speaker 14 as the second cancel signal CA2(n) through the second system variable filter 1121.

In addition, the input noise signal x(n) is transmitted to the second system subtractor 1125 through the second system auxiliary filter 1126, and the second system subtractor 1125 subtracts the output of the second system auxiliary filter 1126 from a second microphone error signal err2(n) picked up by the second microphone 15 and outputs the result, as the error e2, to the second system adaptive algorithm execution unit 1122 and the first system signal processing unit 111.

The second system variable filter 1121, the second system adaptive algorithm execution unit 1122, the second system first-stage estimation filter 1123, and the second system second-stage estimation filter 1124 form a filtered-X adaptive filter. In the second system first-stage estimation filter 1123, an estimated transfer characteristic S22ˆ(z) of a transfer function S22(z) from the second system signal processing unit 112 to the second microphone 15 calculated by actual measurement or the like is set in advance. The second system first-stage estimation filter 1123 convolves the input noise signal x(n) with the transfer characteristic S22ˆ(z), and inputs the resultant signal to the second system adaptive algorithm execution unit 1122. In addition, in the second system second-stage estimation filter 1124, an estimated transfer characteristic S12ˆ(z) of a transfer characteristic S12(z) indicating a transfer function from the second system signal processing unit 112 to the first microphone 13 calculated by actual measurement or the like is set in advance. The second system second-stage estimation filter 1124 convolves the input noise signal x(n) with the transfer characteristic S12ˆ(z), and inputs the resultant signal to the second system adaptive algorithm execution unit 1122.

The second system adaptive algorithm execution unit 1122 receives the noise signal x(n) in which the transfer function S22ˆ(z) is convoluted by the second system first-stage estimation filter 1123, the noise signal x(n) in which the transfer function S12ˆ(z) is convoluted by the second system second-stage estimation filter 1124, the error e2 output from the second system subtractor 1125, and the error e1 output from the first system signal processing unit 111, executes an adaptive algorithm, such as NLMS, and performs the adaptive operation of updating a transfer function W2(z) of the second system variable filter 1121 so that the errors become 0. The transfer function H1(z) of the first system auxiliary filter 1116 of the first system signal processing unit 111 and the transfer function H2(z) of the second system auxiliary filter 1126 of the second system signal processing unit 112 can be arbitrarily set by the controller 16.

The controller 16 can control execution of and stop the adaptive operation of the first system adaptive algorithm execution unit 1112 of the first system signal processing unit 111 and execution of and stop the adaptive operation of the second system adaptive algorithm execution unit 1122 of the second system signal processing unit 112.

In a state where the adaptive operation of the first system adaptive algorithm execution unit 1112 of the first system signal processing unit 111 is stopped, the controller 16 can arbitrarily set the transfer function W1(z) of the first system variable filter 1111 of the first system signal processing unit 111. In addition, in a state where the adaptive operation of the second system adaptive algorithm execution unit 1122 of the second system signal processing unit 112 is stopped, the controller 16 can arbitrarily set the transfer function W2(z) of the second system variable filter 1121 of the second system signal processing unit 112.

Next, the contents of the filter management table 17 will be described. As illustrated in FIG. 4, the filter management table 17 is provided with n entries (rows in the drawing) each of which is provided corresponding to one of n cancel point sets. Each cancel point set is a pair of one first cancel point and one second cancel point, and different cancel point sets are different combinations of a first cancel point and a second cancel point.

That is, the n cancel point sets can be set corresponding to different front-back direction positions of the noise cancel target seat, for example, as illustrated in FIGS. 5A1, 5A2, and 5A3. In this case, the first cancel point of each cancel point set is a standard right ear position of the user seated on the noise cancel target seat at the corresponding front-back direction position, and the second cancel point is a standard left ear position of the user seated on the noise cancel target seat at the corresponding front-back direction position.

In addition, in the n cancel point sets, the cancel points may include a plurality of different orientations of the user's head, front, back, left, right, and up and down positions, and cancel points set for each combination thereof.

Referring back to FIG. 4, a first cancel point P1_i and a second cancel point P2_i of an i-th cancel point set, a first system auxiliary filter setting value H1 i(z), a second system auxiliary filter setting value H2 i(z), a first system variable filter initial value W1 i(z), and a second system variable filter initial value W2_i(z) are registered in the entry corresponding to the i-th cancel point set in the filter management table 17.

The first system auxiliary filter setting value H1_i(z), the second system auxiliary filter setting value H2_i(z), the first system variable filter initial value W1 i(z), and the second system variable filter initial value W2_i(z) registered in the entry of each cancel point set of the filter management table 17 are learned in advance and set in the filter management table 17.

The learning of the first system auxiliary filter setting value H1_i(z), the second system auxiliary filter setting value H2_i(z), the first system variable filter initial value W1_i(z), and the second system variable filter initial value W2_i(z) is performed by executing the following first-stage learning processing and second-stage learning processing with the number from 1 to n as i under a standard environment.

Figure 6:
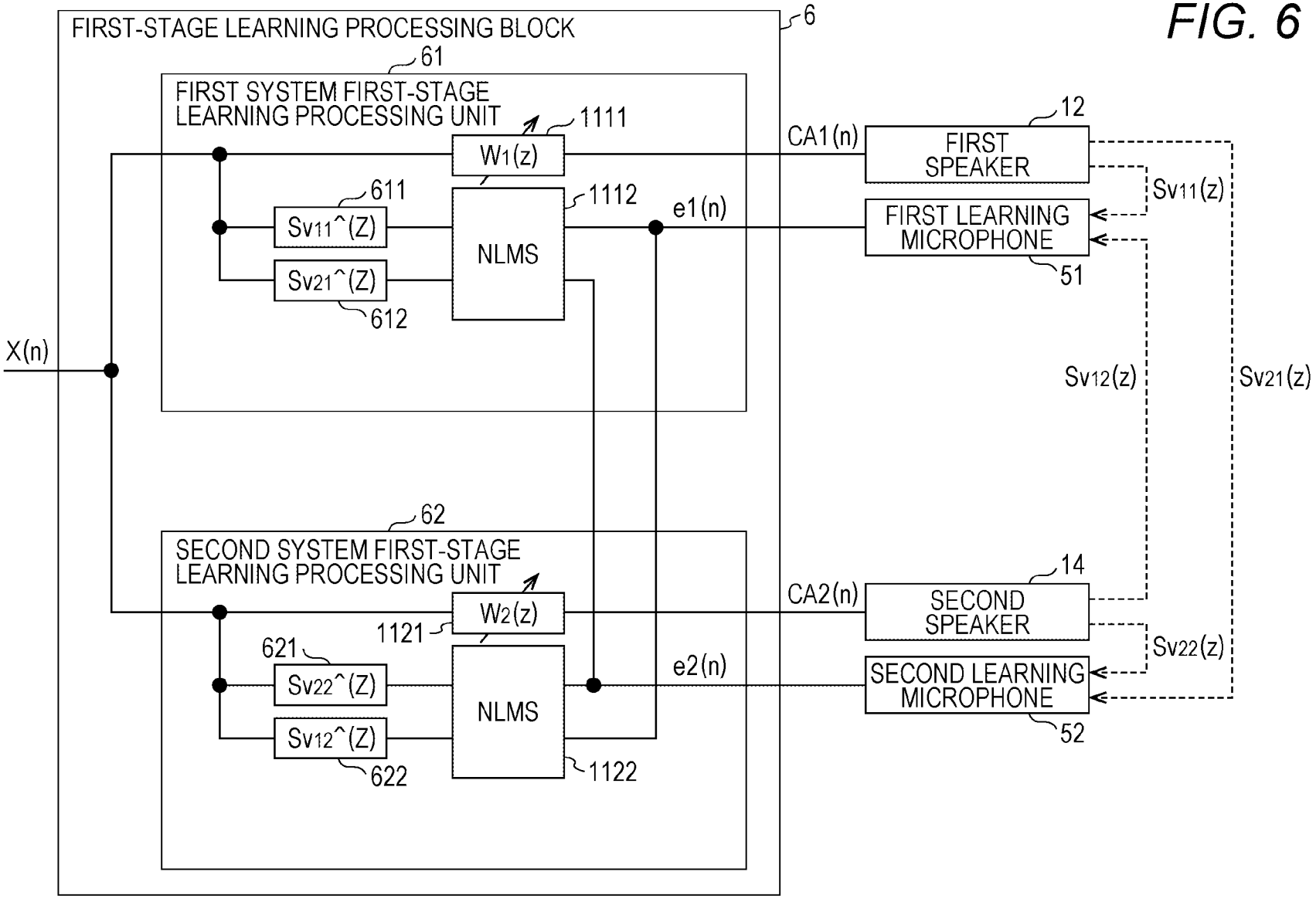
FIG. 6 is a block diagram illustrating a configuration of learning of a transfer function of an auxiliary filter according to the embodiment of the invention.

As illustrated in FIG. 6, the first-stage learning processing is performed in a configuration in which the signal processing block 11 has been replaced with a first-stage learning processing block 6. Further, the first-stage learning processing is performed by connecting a first learning microphone 51 disposed at the first cancel point P1_i of the i-th cancel point set and a second learning microphone 52 disposed at the second cancel point P2_i of the i-th cancel point set to the first-stage learning processing block 6.

For example, as illustrated in FIGS. 5B1 and 5B2, the installation of the first learning microphone 51 and the second learning microphone 52 is performed by seating a dummy doll, where the first learning microphone 51 is fixed at the position of the right ear and the second learning microphone 52 is fixed at the position of the left ear, on the cancel target seat, and adjusting the position of the cancel target seat and the position and posture of the dummy doll such that the first learning microphone 51 is located at the first cancel point P1_i of the i-th cancel point set and the second learning microphone 52 is located at the second cancel point P2_i of the i-th cancel point set.

As illustrated in FIG. 6, the first-stage learning processing block 6 includes a first system first-stage learning processing unit 61 and a second system first-stage learning processing unit 62. The first system first-stage learning processing unit 61 removes the first system subtractor 1115 and the first system auxiliary filter 1116 from the first system signal processing unit 111 of the signal processing block 11 illustrated in FIG. 3, provides a first system first-stage learning estimation filter 611 in which an estimated transfer function Sv11ˆ(z) of a transfer function Sv11(z) from the first system first-stage learning processing unit 61 to the first learning microphone 51 is set instead of the first system first-stage estimation filter 1113, and provides a first system second-stage learning estimation filter 612 in which an estimated transfer function Sv21ˆ(z) of a transfer function Sv21(z) from the first system first-stage learning processing unit 61 to the second learning microphone 52 is set instead of the first system second-stage estimation filter 1114, and both the output of the first learning microphone 51 and the output of the second learning microphone 52 are input to the first system adaptive algorithm execution unit 1112 as errors.

In addition, the second system first-stage learning processing unit 62 removes the second system subtractor 1125 and the second system auxiliary filter 1126 from the second system signal processing unit 112 of the signal processing block 11 illustrated in FIG. 3, provides a second system first-stage learning estimation filter 621 in which an estimated transfer function Sv22ˆ(z) of a transfer function Sv22(z) from the second system first-stage learning processing unit 62 to the second learning microphone 52 is set instead of the second system first-stage estimation filter 1123, and provides a second system second-stage learning estimation filter 622 in which an estimated transfer function Sv12ˆ(z) of a transfer function Sv12(z) from the second system first-stage learning processing unit 62 to the first learning microphone 51 is set instead of the second system second-stage estimation filter 1124, and both the output of the first learning microphone 51 and the output of the second learning microphone 52 are input to the second system adaptive algorithm execution unit 1122 as errors.

In such a configuration, the transfer function W1(z) of the first system variable filter 1111 is converged and stabilized by the adaptive operation by the first system adaptive algorithm execution unit 1112, the transfer function W2(z) of the second system variable filter 1121 is converged and stabilized by the adaptive operation by the second system adaptive algorithm execution unit 1122, the converged and stabilized transfer function W1(z) is learned as the first system variable filter initial value W1_i(z) of the i-th cancel point set, and the converged and stabilized transfer function W2(z) is learned as the second system variable filter initial value W2_i(z) of the i-th cancel point set.

The first system variable filter initial value W1_i(z) and the second system variable filter initial value W2_i(z) learned in this manner are transfer functions of the first system variable filter 1111 and the second system variable filter 1121, respectively. In a case where the environmental conditions are the same as those at the time of learning, the first cancel signal CA1(n) and the second cancel signal CA2(n) for noise cancellation at the first cancel point P1_i and the second cancel point P2_i of the i-th cancel point set are output from the signal processing block 11.

Figure 7:
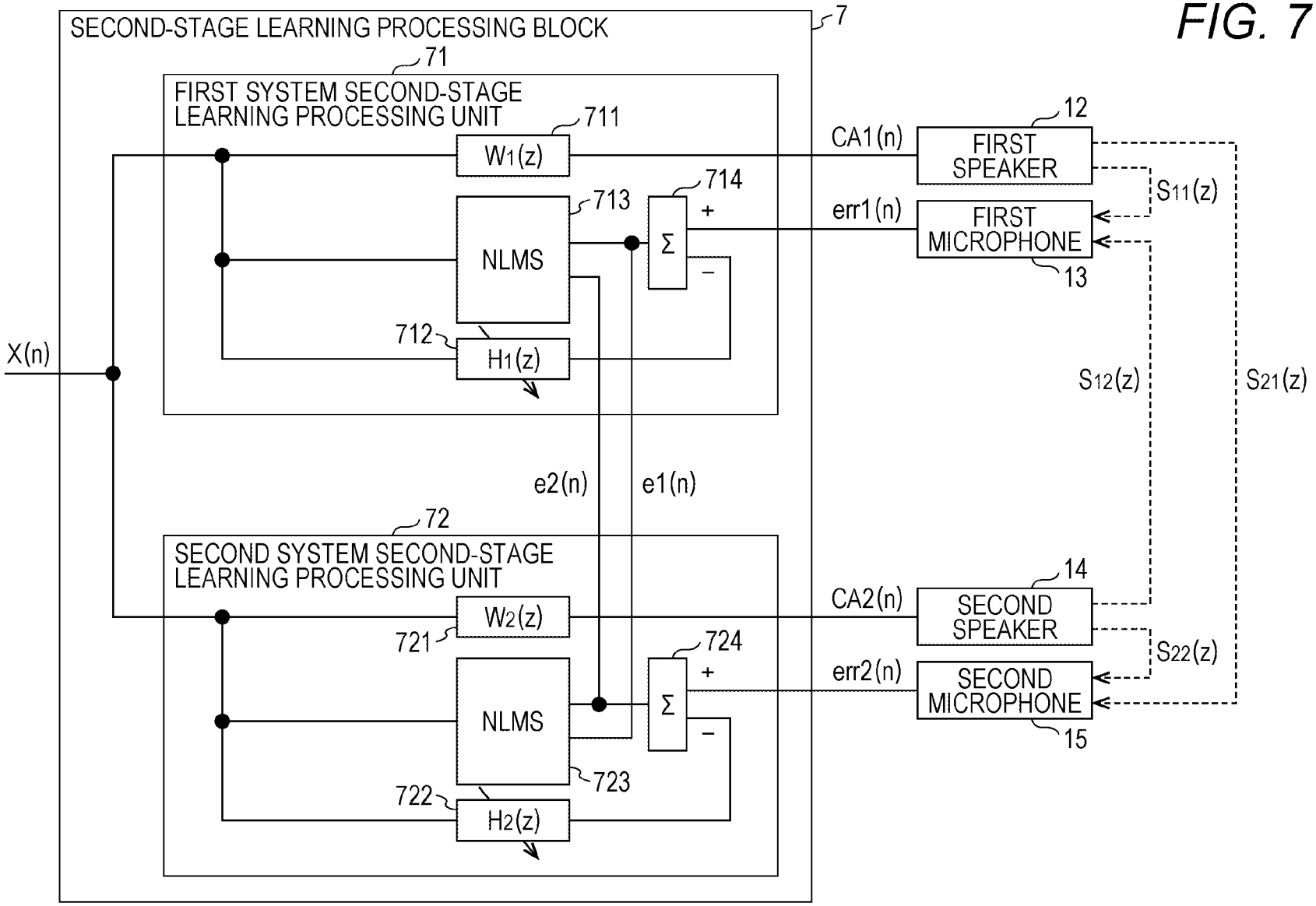
FIG. 7 is a block diagram illustrating a configuration of learning of a transfer function of an auxiliary filter according to the embodiment of the invention.

Next, as illustrated in FIG. 7, the second-stage learning processing is performed in a configuration in which the signal processing block 11 has been replaced with a second-stage learning processing block 7. The second-stage learning processing block 7 includes a first system second-stage learning processing unit 71 and a second system second-stage learning processing unit 72. The first system second-stage learning processing unit 71 includes a first system fixed filter 711 in which the first system variable filter initial value W1_i(z) obtained as a result of the first-stage learning processing is set as a transfer function, a first system second-stage learning variable filter 712, a first system second-stage learning adaptive algorithm execution unit 713, and a first system second-stage subtractor 714.

In addition, the second system second-stage learning processing unit 72 includes a second system fixed filter 721 in which the second system variable filter initial value W2 i(z) obtained as a result of the first-stage learning processing is set as a transfer function, a second system second-stage learning variable filter 722, a second system second-stage learning adaptive algorithm execution unit 723, and a second system second-stage subtractor 724.

The noise signal x(n) input to the first system second-stage learning processing unit 71 is output to the first speaker 12 through the first system fixed filter 711, and the noise signal x(n) input to the second system second-stage learning processing unit 72 is output to the second speaker 14 through the second system fixed filter 721.

Further, the noise signal x(n) input to the first system second-stage learning processing unit 71 is sent to the first system second-stage subtractor 714 through the first system second-stage learning variable filter 712, and the first system second-stage subtractor 714 subtracts the output of the first system second-stage learning variable filter 712 from the signal picked up by the first microphone 13 and outputs the subtracted signal as an error to the first system second-stage learning adaptive algorithm execution unit 713 and the second system second-stage learning adaptive algorithm execution unit 723 of the second system second-stage learning processing unit 72.

Further, the noise signal x(n) input to the second system second-stage learning processing unit 72 is sent to the second system second-stage subtractor 724 through the second system second-stage learning variable filter 722, and the second system second-stage subtractor 724 subtracts the output of the second system second-stage learning variable filter 722 from the signal picked up by the second microphone 15 and outputs the subtracted signal as an error to the second system second-stage learning adaptive algorithm execution unit 723 and the first system second-stage learning adaptive algorithm execution unit 713 of the first system second-stage learning processing unit 71.

The first system second-stage learning adaptive algorithm execution unit 713 of the first system second-stage learning processing unit 71 updates the transfer function H1(z) of the first system second-stage learning variable filter 712 so that the error input from the first system second-stage subtractor 714 and the second system second-stage subtractor 724 becomes 0, and the second system second-stage learning adaptive algorithm execution unit 723 of the second system second-stage learning processing unit 72 updates the transfer function H2(z) of the second system second-stage learning variable filter 722 so that the error input from the first system second-stage subtractor 714 and the second system second-stage subtractor 724 becomes 0.

In such a configuration, the transfer function H1(z) of the first system second-stage learning variable filter 712 is converged and stabilized by the adaptive operation of the first system second-stage learning adaptive algorithm execution unit 713, and the converged and stabilized transfer function H1(z) is learned as the first system auxiliary filter setting value H1_i(z) of the i-th cancel point set. The transfer function H2(z) of the second system second-stage learning variable filter 722 is converged and stabilized by the adaptive operation of the second system second-stage learning adaptive algorithm execution unit 723, and the converged and stabilized transfer function H2(z) is learned as the second system auxiliary filter setting value H2_i(z) of the i-th cancel point set.

When the first system auxiliary filter setting value H1_i(z) and the second system auxiliary filter setting value H2_i(z) learned in this manner are the transfer functions of the first system auxiliary filter 1116 and the second system auxiliary filter 1126, respectively, the first microphone error signal err1(n) output from the first microphone 13 and the second microphone error signal err2(n) output from the second microphone 15 are corrected to outputs in a case where the first microphone 13 and the second microphone 15 are present at the first cancel point P1_i and the second cancel point P2_i of the i-th cancel point set.

Figure 8:
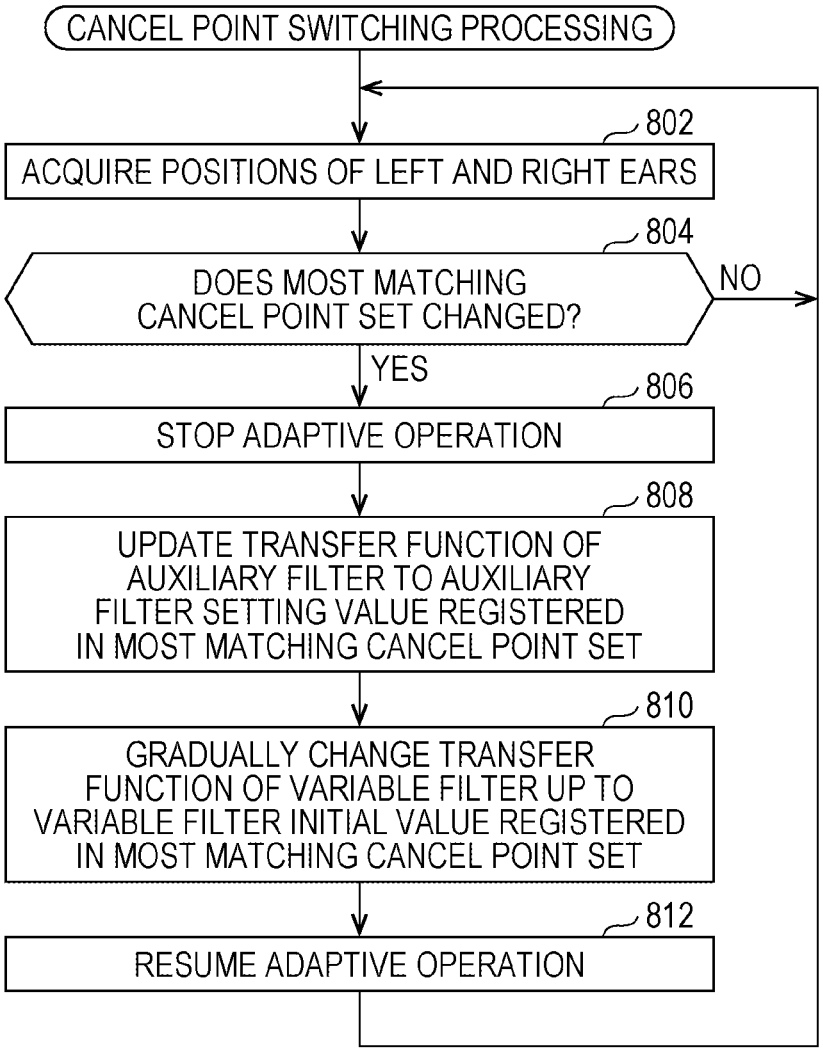
FIG. 8 is a flowchart illustrating cancel point switching processing according to the embodiment of the invention.

Next, control performed by the controller 16 during actual operation of the active noise control system 1 will be described. FIG. 8 illustrates a procedure of cancel point switching processing performed by the controller 16. As illustrated in the drawing, in the cancel point switching processing, the controller 16 acquires the positions of the right ear and the left ear of the user seated on the noise cancel target seat detected by the DMS 18 (Step 802), and monitors the occurrence of a change in the most matching cancel point set which is the cancel point set most matching the acquired positions of the right ear and the left ear (Step 804).

For example, the most matching cancel point set is obtained as a cancel point set in which the sum of the distance between the right ear and the first cancel point and the distance between the left ear and the second cancel point is minimized.

Then, when a change in the most matching cancel point set occurs (Step 804), the adaptive operation of the first system adaptive algorithm execution unit 1112 of the first system signal processing unit 111 and the adaptive operation of the second system adaptive algorithm execution unit 1122 of the second system signal processing unit 112 are stopped (Step 806).

The first system auxiliary filter setting value H1_i(z) registered in the entry of the most matching cancel point set of the filter management table 17 is set as the transfer function H1(z) of the first system auxiliary filter 1116, and the second system auxiliary filter setting value H2_i(z) registered in the entry is set as the transfer function H2(z) of the second system auxiliary filter 1126 (Step 808).

The transfer function W1(z) of the first system variable filter 1111 of the first system signal processing unit 111 is gradually changed from the current value to the first system variable filter initial value W1_i(z) registered in the entry of the most matching cancel point set of the filter management table 17, and the transfer function W2(z) of the second system variable filter 1121 of the second system signal processing unit 112 is gradually changed from the current value to the second system variable filter initial value W2_i(z) registered in the entry (Step 810).

The change of the transfer function W1(z) of the first system variable filter 1111 and the transfer function W2(z) of the second system variable filter 1121 may be performed by changing the transfer function W1(z) of the first system variable filter 1111 and the transfer function W2(z) of the second system variable filter 1121 by unit amount per unit time, or may be performed so as to change the first system variable filter initial value W1_i(z) and the second system variable filter initial value W2_i(z), respectively, in a predetermined time. The transfer function W1(z) of the first system variable filter 1111 and the transfer function W2(z) of the second system variable filter 1121 are actually changed by gradually updating the value of each tap coefficient of each variable filter to the changed value of the tap coefficient. In addition, the value of the tap coefficient at each time point during the change is obtained by, for example, linear interpolation of the tap coefficient before the change and the tap coefficient after the change.

Then, when the transfer function W1(z) of the first system variable filter 1111 of the first system signal processing unit 111 gradually changes to become the first system variable filter initial value W1_i(z) registered in the entry of the most matching cancel point set and the transfer function W2(z) of the second system variable filter 1121 of the second system signal processing unit 112 gradually changes to become the second system variable filter initial value W2_i(z) registered in the entry, the adaptive operation of the first system adaptive algorithm execution unit 1112 of the first system signal processing unit 111 and the adaptive operation of the second system adaptive algorithm execution unit 1122 of the second system signal processing unit 112 are restarted (Step 812).

Then, the processing returns to the processing from Step 802. The cancel point switching processing performed by the controller 16 has been described above. Note that the first system auxiliary filter setting value H1_i(z), the second system auxiliary filter setting value H2_i(z), the first system variable filter initial value W1_i(z), and the second system variable filter initial value W2_i(z) registered in the filter management table 17 are not actually transfer functions themselves, but information for setting the first system auxiliary filter setting value H1_i(z) as a transfer function of the first system auxiliary filter 1116, information for setting the second system auxiliary filter setting value H2_i(z) as a transfer function of the second system auxiliary filter 1126, and information for setting the first system variable filter initial value W1_i(z) as a transfer function of the first system variable filter 1111, and information for setting the second system variable filter initial value W2 i(z) as a transfer function of the second system variable filter 1121. In the cancel point switching processing, the transfer functions of the first system auxiliary filter 1116, the second system auxiliary filter 1126, the first system variable filter 1111, and the second system variable filter 1121 are set using these pieces of information as described above.

According to the cancel point switching processing as described above, when the displacement of the user's ear occurs, the transfer functions of the first system variable filter 1111, the second system variable filter 1121, the first system auxiliary filter 1116, and the second system auxiliary filter 1126 are updated to the transfer functions that cancel the noise at the first cancel point and the second cancel point of the most matching cancel point set matching the positions of the user's left and right ears under the environmental conditions at the time of learning described above.

The signal processing block 11 thus updated restarts the adaptive operation and performs the adaptive operation to absorb the difference between the environmental condition at the time of learning and the environmental condition at the present time to update the transfer function W1(z) of the first system variable filter 1111 and the transfer function W2(z) of the second system variable filter 1121 to the transfer functions that cancel noise at the first cancel point and the second cancel point of the most matching cancel point set.

Since it can be expected that the environmental conditions at the time of learning and the environmental conditions at the present time do not greatly differ, the transfer functions of the first system variable filter 1111 and the second system variable filter 1121 that have been updated are transfer functions approximate to transfer functions that can cancel noise at the first cancel point and the second cancel point of the most matching cancel point set. Adaptation of the transfer function W1(z) of the first system variable filter 1111 and the transfer function W2(z) of the second system variable filter 1121 is completed in a short time after the start of the adaptive operation, noise is canceled within a certain range close to the first cancel point and the second cancel point of the most matching cancel point set, and noise is canceled at the positions of the left and right ears of the user close to the first cancel point and the second cancel point of the most matching cancel point set.

In addition, since this update is performed in a mode in which the transfer functions of the first system variable filter 1111 and the second system variable filter 1121 are gradually changed in a state in which the adaptive operations of the first system variable filter 1111 and the second system variable filter 1121 that generate the first cancel signal CA1(n) and the second cancel signal CA2(n) are stopped until the update is completed, it is also suppressed that an unnatural sound generated when the transfer functions of the first system variable filter 1111 and the second system variable filter 1121 are changed at once is output to the user in association with the update.

In the above embodiment, instead of changing the transfer functions of the first system auxiliary filter 1116 and the second system auxiliary filter 1126, a plurality of sets of the first system auxiliary filter 1116 and the second system auxiliary filter 1126 in which the transfer functions corresponding to the respective noise cancel point sets are set may be provided, and the set of the first system auxiliary filter 1116 and the second system auxiliary filter 1126 used as the active use may be switched to the set of the first system auxiliary filter 1116 and the second system auxiliary filter 1126 corresponding to the most matching cancel point set.

In addition, in the above description, a case where there is only one noise source has been described. However, the above embodiment can also be applied to a case where there is a plurality of noise sources by extending the configuration of the signal processing block 11 so as to consider the propagation of noise from each noise source to each cancel point.

Further, in the above embodiment, the case where the microphone, the speaker, and the signal processing unit are provided for each of the right ear and the left ear has been described. However, this embodiment can be similarly applied to a case where the microphone, the speaker, and the signal processing unit are provided for the head, and the noise audible in the right ear and the left ear is collectively canceled by the microphone, the speaker, and the signal processing unit common to the right ear and the left ear according to the position of the user's head detected by the DMS 18.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An active noise control system for reducing noise, the active noise control system comprising:

a position detection unit configured to detect a listening position that is a position at which a user listens to a sound;

a control unit;

a speaker configured to output a noise cancel sound;

a microphone configured to detect an error signal;

at least one auxiliary filter configured to receive a noise signal representing noise and to generate and output a correction signal by applying a transfer function which is set in the auxiliary filter to the noise signal;

an error correction unit configured to correct an error signal that is an output of the microphone with the correction signal output from the auxiliary filter and output a corrected error signal;

an adaptive filter configured to receive the noise signal and perform an adaptive operation using the corrected error signal output by the error correction unit to generate a cancel signal provided to the speaker, which outputs the noise cancel sound; and a storage unit configured to store a plurality of noise cancel positions and setting information for setting an adaptive filter initial transfer function corresponding to each of the noise cancel positions in the adaptive filter, wherein when the position detection unit detects a change in the listening position of the user, the control unit identifies the noise cancel position from among the plurality of noise cancel positions that matches the changed listening position, sets an auxiliary filter with a transfer function set in advance that corresponds to the matched noise cancel position, and performs a switching operation of updating a transfer function of the adaptive filter to the initial transfer function corresponding to the matched noise cancel position by using the stored setting information;

wherein in a state in which the adaptive operation of the adaptive filter is stopped in the switching operation and an auxiliary filter with a transfer function set in advance that corresponds to the matched noise cancel position is set, the control unit gradually changes the transfer function of the adaptive filter to an adaptive filter initial transfer function corresponding to the matched noise cancel position, updates the transfer function of the adaptive filter to the adaptive fitter initial transfer function, and then restarts the adaptive operation of the adaptive filter.

2. The active noise control system according to claim 1, wherein an adaptive filter initial transfer function corresponding to each of the noise cancel positions is a transfer function that generates a noise cancel sound with which the adaptive filter cancels noise at a noise cancel position corresponding to the adaptive filter initial transfer function under a standard environment when the adaptive filter initial transfer function is set, where the standard environment comprises environmental conditions at a time of learning processing, and a transfer function of the auxiliary filter corresponding to each of the noise cancel positions is a transfer function that, when the transfer function of the auxiliary filter is set, the auxiliary filter outputs a correction signal in which an error signal that is an output of the microphone is corrected by an error correction unit so that a difference between a noise cancel position corresponding to the transfer function of the auxiliary filter and a position of the microphone is compensated.

3. The active noise control system according to claim 1, wherein an adaptive filter initial transfer function corresponding to each of the noise cancel positions is a transfer function that is learned by using a learning microphone disposed al a noise cancel position corresponding to the adaptive filter initial transfer function and with which the adaptive filter generates a noise cancel sound that cancels noise at the corresponding noise cancel position, and a transfer function for an auxiliary filter corresponding to each of the noise cancel positions is a transfer function learned in advance as a transfer function with which the auxiliary filter outputs a correction signal for correcting the error signal to 0 in an error correction unit in a state where the transfer function of the adaptive filter is fixed to the adaptive filter initial transfer function corresponding to the noise cancel position.

4. The active noise control system according of claim 3, wherein the position detection unit detects a position of a head or an ear of a user seated on a predetermined seat of an automobile as the listening position.

5. An active noise control system for reducing noise, the active noise control system comprising:

a position detection unit configured to detect positions of left and right ears of a user;

a control unit;

two noise control systems comprising a right ear noise control system and a left ear noise control system; and a storage unit, wherein each noise control system includes:

a speaker configured to output a noise cancel sound;

a microphone configured to detect an error signal;

at least one auxiliary filter configured to receive a noise signal representing noise and to generate and output a correction signal by applying a transfer function set in the auxiliary filter to the noise signal;

an error correction unit configured to correct an error signal that is an output of the microphone with the correction signal output from the auxiliary filter and outputs the corrected error signal; and an adaptive filter configured to receive the noise signal and perform an adaptive operation using the corrected error signal output from the error correction unit of the right ear noise control system and a corrected error signal output from the error correction unit of the left ear noise control system to generate a cancel signal provided to the speaker, which outputs the noise cancel sound, the storage unit stores a plurality of noise cancel position sets comprising a first noise cancel position and a second noise cancel position as a noise cancel position set, and setting information for setting a first adaptive filter initial transfer function and a second adaptive filter initial transfer function corresponding to each noise cancel position set to an adaptive filter of the right ear noise control system and to an adaptive filter of the left ear noise control system respectively, and when the position detection unit detects a change in the position of the left and right ears of the user, the control unit identifies the noise cancel position set from among the plurality of noise cancel position sets that matches the changed position and performs a switching operation of setting an auxiliary filter of each of the right ear noise control system and the left ear noise control system with a transfer function set in advance that corresponds to the matched noise cancel position set, and updating a transfer function of the adaptive filter of each of the right ear noise control system and the left ear noise control system to the respective first adaptive filter initial transfer function and second adaptive filter initial transfer function corresponding to the matched noise cancel position set by using the stored setting information; wherein in the switching operation, the control unit is configured to, in a state where an auxiliary filter that stops an adaptive operation of the adaptive filers of the right ear noise control system and the left ear noise control system and outputs a correction signal to the error correction unit of the right ear noise control system is an auxiliary filter in which a transfer function for a first auxiliary fitter corresponding to the matched noise cancel position set is set, and an auxiliary filter that outputs a correction signal to the error correction unit of the left ear noise control system is an auxiliary filter in which a transfer function for a second auxiliary filter corresponding to the matched noise cancel position set is set, update a transfer function of an adaptive filter of the right ear noise control system to a first adaptive fitter initial transfer function corresponding to the matched noise cancel position set by gradually changing the transfer function to the first adaptive filter initial transfer function, update a transfer function of an adaptive filter of the left ear noise control system to a second adaptive filter initial transfer function corresponding to the matched noise cancel position set by gradually changing the transfer function to the second adaptive filter initial transfer function, and then resume an adaptive operation of the adaptive fitters of the right ear noise control system and the left ear noise control system.

6. The active noise control system according to claim 5, wherein the matched noise cancel position set is a noise cancel position set in which a position of the right ear of the user detected by the position detection unit is matched with the first noise cancel position, and a position of the left ear of the user detected by the position detection unit is matched with the second noise cancel position, the first adaptive filter initial transfer function and the second adaptive filter initial transfer function corresponding to each of the noise cancel position sets are transfer functions for generating a noise cancel sound with which adaptive filters of the right ear noise control system and the left ear noise control system cancel noise at the first noise cancel position and the second noise cancel position of a noise cancel position set corresponding to the first adaptive filter initial transfer function and the second adaptive filter initial transfer function under a standard environment when the first adaptive filter initial transfer function is set to the right ear noise control system and the second adaptive filter initial transfer function is set to the left ear noise control system, where the standard environment comprises environmental conditions at a time of learning processing, and a transfer function for a first auxiliary filter corresponding to each of the noise cancel position sets is a transfer function with which, when the transfer function for the first auxiliary fitter is set in the right ear noise control system, the auxiliary filter outputs a correction signal in which an error signal that is an output of the microphone is corrected by an error correction unit such that a difference between a first noise cancel position of a noise cancel position set corresponding to the transfer function for the first auxiliary filter and a position of a microphone is compensated, and a transfer function for a second auxiliary filter corresponding to each of the noise cancel position sets is a transfer function with which, when the transfer function for the second auxiliary filter is set in the left ear noise control system, the auxiliary filter outputs a correction signal in which an error signal that is an output of the microphone is corrected by an error correction unit such that a difference between a second noise cancel position of a noise cancel position set corresponding to the transfer function for the second auxiliary fitter and a position of a microphone is compensated.

7. The active noise control system according to claim 5, wherein the first adaptive filter initial transfer function and the second adaptive filter initial transfer function corresponding to each of the noise cancel position sets are transfer functions generated by the adaptive filters of the right ear noise control system and the left ear noise control system for noise cancel sounds that cancel noise at the first noise cancel position and the second noise cancel position of the corresponding noise cancel position set, the noise cancel sounds having been learned using the first learning microphone arranged at the first noise cancel position of the noise cancel position set and the second learning microphone arranged at the second noise cancel position of the noise cancel position set, and in a state where a transfer function of the adaptive filter of the right ear noise control system is fixed to the first adaptive fitter initial transfer function corresponding to the first noise cancel position of the noise cancel position set and a transfer function of the adaptive filter of the left ear noise control system is fixed to the second adaptive filter initial transfer function corresponding to the second noise cancel position of the noise cancel position set, in the right ear noise control system, the transfer function for the first auxiliary filter corresponding to each of the noise cancel position sets is a transfer function learned in advance as a transfer function with which the auxiliary filter outputs a correction signal for correcting the error signal to 0 in an error correction unit, and in a state where a transfer function of an adaptive filter of the right ear noise control system is fixed to the first adaptive filter initial transfer function corresponding to the first noise cancel position of the noise cancel position set and a transfer function of an adaptive filter of the left ear noise control system is fixed to the second adaptive filter initial transfer function corresponding to the second noise cancel position of the noise cancel position set, in the left ear noise control system, the transfer function for the second auxiliary filter corresponding to each of the noise cancel position sets is a transfer function learned in advance as a transfer function with which the auxiliary filter outputs a correction signal for correcting the error signal to 0 in an error correction unit.

8. The active noise control system according to claim 7, wherein the position detection unit detects positions of left and right ears of a user seated on a predetermined seat of an automobile.

* * * * *